US007374847B2

(12) United States Patent
Oshiba et al.

(10) Patent No.: US 7,374,847 B2
(45) Date of Patent: May 20, 2008

(54) TONER AND DEVELOPER FOR DEVELOPING ELECTROSTATIC IMAGE AND IMAGE FORMING METHOD

(75) Inventors: Tomomi Oshiba, Hachioji (JP); Ken Ohmura, Hachioji (JP); Shigenori Kouno, Hachioji (JP); Hiroshi Yamazaki, Hachioji (JP)

(73) Assignee: Konica Corporation (JP)

( * ) Notice: Subject to any disclaimer, the term of this patent is extended or adjusted under 35 U.S.C. 154(b) by 270 days.

(21) Appl. No.: 10/734,942

(22) Filed: Dec. 12, 2003

(65) Prior Publication Data

US 2006/0177752 A1 Aug. 10, 2006

Related U.S. Application Data

(63) Continuation of application No. 09/505,459, filed on Feb. 11, 2000, now abandoned.

(30) Foreign Application Priority Data

Feb. 12, 1999 (JP) ..... 11-034907

(51) Int. Cl.
*G03G 9/087* (2006.01)
*G03G 9/09* (2006.01)

(52) U.S. Cl. ..... 430/108.21; 430/108.24; 430/111.4; 430/123.57

(58) Field of Classification Search ..... 430/108.24, 430/108.3, 111.4, 108.21, 108.23, 108.1, 430/106.2, 110.1, 110.2, 126, 108.4, 121.1, 430/123.57

See application file for complete search history.

(56) References Cited

U.S. PATENT DOCUMENTS

| | | | | | |
|---|---|---|---|---|---|
| 4,702,987 | A | * | 10/1987 | Fukuchi et al. | 430/122 |
| 4,980,257 | A | * | 12/1990 | Anno et al. | 430/110.2 |
| 5,376,493 | A | * | 12/1994 | Kobayashi | 430/137.18 |
| 5,645,967 | A | * | 7/1997 | Sato et al. | 430/108.1 |
| 5,672,454 | A | * | 9/1997 | Sasaki et al. | 430/110.2 |
| 5,763,130 | A | * | 6/1998 | Sasaki et al. | 430/110.2 |
| 5,856,055 | A | * | 1/1999 | Ugai et al. | 430/108.23 |
| 6,013,406 | A | * | 1/2000 | Moriki et al. | 430/108.22 |
| 6,238,836 | B1 | * | 5/2001 | Nakamura et al. | 430/108.21 |

OTHER PUBLICATIONS

ACS on STN, File Registry No. RN 1317-61-9, entered STN of Nov. 16, 1984, copyright 2006.*
ACS on STN, File Registry No. RN 147-14-8, entered STN of Nov. 16, 1984, copyright 2006.*

* cited by examiner

*Primary Examiner*—Janis L. Dote
(74) *Attorney, Agent, or Firm*—Cantor Colburn LLP

(57) ABSTRACT

A toner for developing an electrostatic image is disclosed. The toner contains an amount of not less than 0.1% by weight of an element selected from elements of the Groups of 1B, 2B, 4B, 5B, 6B, 7B, 8, 3A and 4A of the fourth and fifth periodic of the long periodic table of the elements, and the isolation ratio of the element is not more than 10% by number.

7 Claims, 1 Drawing Sheet

TONER AND DEVELOPER FOR DEVELOPING ELECTROSTATIC IMAGE AND IMAGE FORMING METHOD

CROSS-REFERENCE TO RELATED APPLICATION

This application is a continuation of U.S. patent application Ser. No. 09/505,459, filed Feb. 11, 2000 now abandoned, the entire contents of which are incorporated herein by reference.

FIELD OF THE INVENTION

The invention relates to a toner for developing an electrostatic image, a developer comprising the toner and an image forming method using the developer.

BACKGROUND OF THE INVENTION

Generally, in an electrophotographic method utilized for image formation by a copying machine, a static charge is uniformly formed on the surface of a photoreceptor having a photoreceptive layer composed of a photoconductive material. Then a electrostatic image corresponding to the image to be formed is made on the surface of the photoreceptor by imagewise exposing to light. The electrostatic image is developed by a developer to form a toner image. The toner image is transferred to a recording medium such as paper and fixed.

Many characteristics are required to the developer to be used for the electrophotographic method. For example, a coloring ability, suitable electrostatic, thermal, mechanical and chemical properties, a suitable fluidity, an anti-blocking property and a powder property relating to the particle size distribution are required to the toner in the developer. The toner is comprised of a binder resin and a complex fine particle which is composed of a colorant and various materials for satisfying such the requirements.

When the image forming operation are repeatedly performed using such the developer, it is often observed that a charge providing member such as a carrier and a blade for forming a thin layer of developer was contaminated by a part of the materials constituting the toner, with the result that the static property of the toner is changed and a bad influence is occurred on the image quality. However, the material contaminating the charge providing member is various since the toner is constituted with various kinds of material. Accordingly, any simple relation cannot be found between the amount of the contaminating material and the variation of the charging property. As a result of that, effective countermeasure cannot be taken in the present condition.

SUMMARY OF THE INVENTION

The first object of the invention is to provide a toner for developing electrostatic image by which the change in the charging property caused by contamination of the charge providing member is inhibited when the image formation is continued for a long period of time, and stable images are formed for many times of image formation.

The second object of the invention is to provide a developer for developing electrostatic image by which the change in the charging property caused by contamination of the charge providing member is inhibited when the image formation is continued for a long period of time, and stable images are formed for many times of image formation.

The third object of the invention is to provide an image forming method for developing electrostatic image by which the change in the charging property caused by contamination of the charge providing member is inhibited when the image formation is continued for a long period of time, and stable images are formed for many times of image formation.

The toner for developing an electrostatic image of the invention contains an amount of not less than 0.1% by weight of an element selected from the elements of the Groups of 1B, 2B, 4B, 5B, 6B, 7B, 8, 3A and 4A of the fourth and fifth periodic of the long periodic table of the elements, and the isolation ratio of the element is not more than 10% by number.

In the toner for developing electrostatic image of the invention, the isolation ratio of the element is preferably not more than 5% by number, more preferably not more than 2.5% by number.

When the developer is a single-component developer, the developer contains the above-mentioned toner for developing electrostatic image.

When the developer is a two-component developer, the developer contains the above-mentioned toner for developing electrostatic image and a carrier.

The image forming methods comprises the steps of forming an electrostatic image on the surface of a photoreceptor, developing the electrostatic image by a developer to form a toner image, transferring the developed toner image to a recording medium and fixing the toner image transferred on the recording medium, in which the above-mentioned developer for developing electrostatic image is used.

DETAILED DESCRIPTION OF THE INVENTION

Toner for Developing Electrostatic Image

Figure 1:
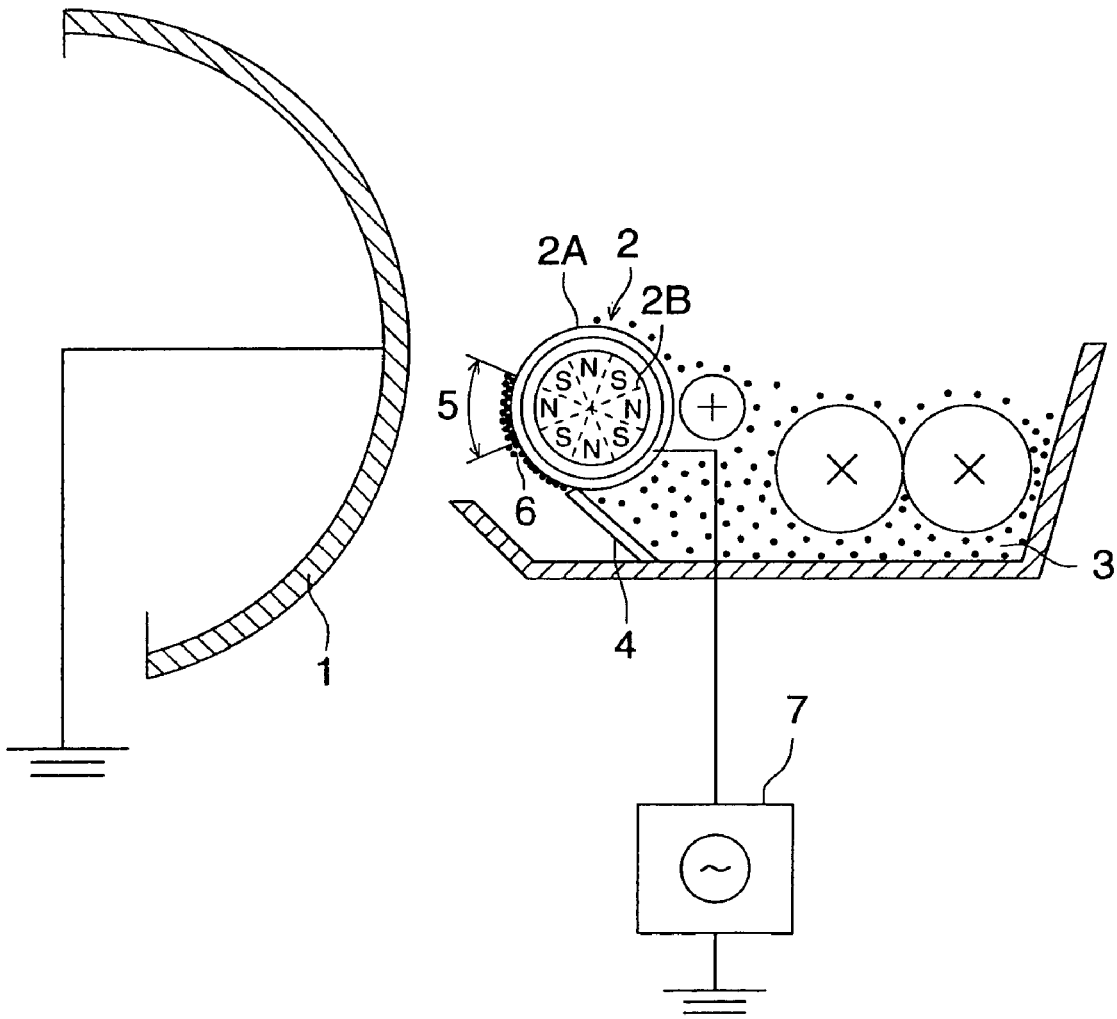
FIG. 1 is a scheme of a developing section for non-contacting developing method.

The toner for developing electrostatic image of the invention basically comprises a colored particle containing a binder resin, a colorant and an elements selected from those of Groups 1B, 2B, 4B, 5B, 6B, 7B, 8, 3A and 4A of the fourth and fifth periodic of the long periodic table of the elements in an amount of not less than 0.1% by weight.

Concrete examples of preferable such the element, hereinafter referred to the specified element, are copper, chromium, iron, zinc and molybdenum. Although the function of the specified element has not been confirmed, a large triboelectricity generating ability is given to the toner by the existence of a small amount of the element in the isolated state since the element has a strong triboelectricity giving ability caused by the atomic structure of the element itself. It is presumed, therefore, that the specified element in the isolated state strongly contributes to the stability of the electricity ability of the developer for a long period of time.

The specified element can be contained in the toner, for example, in a form of pigment, charge controlling agent or metal oxide, although may be contained in a form of elemental metal. Concretely, the specified element can be contained by adding into a component of toner, for example, a pigment such as copper phthalocyanine pigment, a magnetic powder such as magnetite and ferrite, and a charge controlling agent such as an chromium azo complex, a chromium salicylic acid complex, a zinc salicylic acid complex, a zinc salicylic acid complex and a molybdenum quaternary ammonium complex.

The content of the specified element in the toner can be measured by an ordinary element analyzing method, preferably by a fluorescent X-ray analyzing method. In concrete, the element in the toner is qualitatively analyzed by using fluorescent X-ray and a quantitative curve is drawn at the same time. The content of the specified element in the toner can be defined by the quantitative analysis of the specified element according to the quantitative curve.

In the toner for developing electrostatic image according to the invention, the isolation ratio of the specified element is not more than 10%, preferably not more than 5%, more preferably not more than 2.5%, by number.

When such the condition is satisfied, the amount of the material containing the specified element transferred to the charge providing member is inhibited. As a result, the variation of the charging property of the toner is inhibited and many images can be stably formed even when the image formation is continuously repeated for a long period.

When the isolation ratio of the specified element exceeds 10% by number, various problems are raised since the variation in the electricity of the toner is become relatively large when the image formation using such the toner is repeated for a long period of time.

The lower limit of the isolation ratio of the specified element is 0.1% by number. When the ratio is less than 0.1% by number, the electricity of the toner is lowered since the electricity giving ability of the specified element is become insufficient.

The "isolation ratio" of the specified element is a ratio (% by number) of the number of the particles containing the specified element other than the colored particle, for example, particles of the magnetic substance and the charge controlling agent, to the whole number of particles of the toner.

The isolation ratio of the specified element can be measured by the following procedure.

The toner is sampled on a filter using a low volume sampler. The sampled toner is rapidly sucked by an aspirator to separate to individual the particle. The particles are introduced into He microwave plasma to be subjected to an emission spectrographic analysis. In the emission spectrographic analysis, plural spectroscopes are used so that carbon and the specified element contained in an amount not less than 0.1% by weight can be detected by fluorescent X-ray analysis. Then the results of the spectrographic analysis are checked so as to classify the particles to synchronous light emission particles and non-synchronous light emission particles. When a particle emits light, the particle is a synchronous light emission particle if both of light caused by carbon atom and that caused by the specified element are observed at the same time, and the particle is a the non-synchronous light emission particle if both of light caused by carbon atom and that caused by the specified element are not observed at the same time.

The number of the particle containing the specified element which synchronously emits light caused by the specified element with light caused by carbon atom, hereinafter referred to as synchronous light emission particle, and the number of the particle containing the specified element which emits light caused by the specified element without synchronous light emission caused by carbon atom, herein after referred to as non-synchronous light emission particle, are counted. The ratio of the number of non-synchronous light emission particle to the sum of the number of the synchronous and non-synchronous light emission particle is defined as the isolation ratio of the specified element in percent by number.

In the above procedure, Particle Analyzer PT-1000, manufactured by Yokogawa Denki Co., Ltd., can be used for fluorescent analyzing the particles constituting the toner.

The toner for developing electrostatic image according to the invention may be one prepared by melting and kneading the binder resin, colorant and an internal additive to be added by necessity and crushing and classifying the kneaded product, hereinafter referred to Toner A, or one prepared by a polymerization method, hereinafter referred to Toner B.

Toner A

A binder resin to prepare the Toner A, such as a styrene resin, an acryl resin, a styrene/acryl resin and a polyester resin, is usable for the binder resin of the toner of the invention.

A colorant to prepare the Toner A, such as carbon black, a magnetic material, a dye and a pigment, is usable for the colorant of the toner.

Examples of the carbon black usable as the colorant include channel black, furnace black, acetylene black, thermal black and lump black.

Examples of the magnetic substance include a ferromagnetic metal such as iron, nickel and cobalt, an alloy containing such the metal, a compound of a ferromagnetic metal such as ferrite and magnetite, a ferromagnetic alloy by a heat treatment even though containing no ferromagnetic metal such as a kind of alloy called Heuslar alloy such as manganese-copper-aluminum and manganese-copper-tin, and chromium dioxide.

As the dye, for example, C.I. Solvent Red series of 1, 49, 52, 58, 63, 111, and 122, C.I. Solvent Yellow series of 19, 44, 77, 79, 81, 82, 93, 98, 103, 104, 112 and 162, and C.I. Solvent Blue series of 25, 36, 60, 70, 93 and 95, are usable. A mixture of them may also be used.

Examples of the pigment include C.I. Pigment Red series of 5, 48:1, 53:1, 57:1, 122, 139, 144, 149, 166, 177, 178 and 222, C.I. Pigment Orange series of 31 and 43, C.I. Pigment Yellow series of 14, 17, 93, 94 and 138, C.I. Pigment Green 7, C.I. Pigment Blue series of 15:3 and 60. These pigments may be used singly or in combination.

Number average of primary particle diameter of the colorant, which may vary depending on the species, is preferably about 10 to 200 nm.

The amount of the colorant is not particularly specified as far as it is sufficient to form images, and 1 to 10 weight percent in, the Toner A is preferable.

Examples of internal additive to be added in the toner include a releasing agent, a charge controlling agent, etc.

Practical examples of the releasing agent include polyolefin compounds such as low molecular weight polypropylene having number average molecular weight of 1,500 to 9,000, low molecular weight polyethylene, ethylene-propylene copolymer, microcrystaline wax, Carnauba wax, Sazole wax, paraffin wax, amide wax etc.

Practical examples of the charge controlling agent include a negative charge controlling agent an azo metal complex such as azo chromium complex, a salicylic chromium complex, a salicylic zinc complex and a calixarene compound, a positive charge controlling agent such as a Nigrosine dye and a quaternary ammonium salt, etc.

In Toner A, the isolation ratio of the specified element can be controlled by changing conditions of the crushing or the classification. The isolation of the specified element can be inhibited when the crushing is performed under a mild condition so as to inhibit crushing at the interface between the substance containing the specified element and the resin. Particularly, a mechanical crushing method is preferable since crushing at die interface is difficultly occurred and the formation of the isolated matter can be inhibited by such the method compared with an air-current crushing method. Examples of the mechanical crushing apparatus include TURBOMILL, manufactured by Turbo Kogyo Co., Ltd., and CRYPTRON manufactured by Kawasaki Juko Co., Ltd. In the classifying process, a suitable isolation ratio can be obtained by repeating the classification while feedbacking the result of monitoring on the final isolation ratio.

Toner B Various methods for polymerization method to prepare the Toner B can be employed. The preferable example is emulsion polymerization, particularly the method of the following (1) and (2).

(1) The toner of the present invention is prepared by employing the following method. Polymer particles containing a colorant are prepared by emulsion polymerization in aqueous dispersion containing the colorant and additives added if necessary. Coagulated polymer particles are formed by adding a coagulant in an amount of more than the critical coagulation concentration and organic solvents which are infinitely soluble into the obtained dispersion so that the polymer particles are associated. The resultant is heated at least to the glass transition temperature of the polymer.

(2) The toner of the present invention is prepared employing the following method. Polymer particles are prepared by emulsion polymerization in aqueous dispersion containing additives added if necessary. Coagulated polymer particles are formed by adding a coagulant in an amount of more than the critical coagulation concentration and organic solvents which are infinitely soluble into the obtained dispersion and colorant so that the polymer particles are associated. The resultant is heated at least to the glass transition temperature of the polymer.

The method (1) is preferred to (2).

Employed polymerizable monomers to constitute a resin include styrenes or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; acrylic acid or methacrylic acid derivatives such as acrylonitrile, methacrylonitrile, acrylamide and the like. These vinyl based monomers may be employed individually or in combination.

Furthermore, still more preferably employed as polymerizable monomers, which constitute a resin, are those having an ionic dissociation group in combination, which are, for example, have a substituent such as a carboxyl group, a sulfonic acid group, a phosphoric acid group, and the like as a group constituting the substituent. Listed as specific examples are acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosoxyethyl methacrylate, 3-chloro-2-acidphophoxypropyl methacrylate, and the like.

Further, the resin may be modified so as to have a cross-linking structure, employing multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

A radical polymerization initiator includes a water-soluble initiator such as peroxide salt compound (for example, potassium peroxide, ammonium peroxide), salt of azobisaminodipropane acetic acid, azobiscyano valerate, azobiscyano valeric acid, and hydrogen peroxide.

A colorant such as carbon black, a magnetic material, a dye and a pigment, is usable for the colorant of the toner.

Examples of the carbon black usable as the colorant include channel black, furnace black, acetylene black, thermal black and lump black.

Examples of the magnetic substance include a ferromagnetic metal such as iron, nickel and cobalt, an alloy containing such the metal, a compound of a ferromagnetic metal such as ferrite and magnetite, a ferromagnetic alloy by a heat treatment even though containing no ferromagnetic metal such as a kind of alloy called Heuslar alloy such as manganese-copper-aluminum and manganese-copper-tin, and chromium dioxide.

As the dye, for example, C.I. Solvent Red series of 1, 49, 52, 58, 63, 111, and 122, C.I. Solvent Yellow series of 19, 44, 77, 79, 81, 82, 93, 98, 103, 104, 112 and 162, and C.I. Solvent Blue series of 25, 36, 60, 70, 93 and 95, are usable. A mixture of them may also be used.

Examples of the pigment include C.I. Pigment Red series of 5, 48:1, 53:1, 57:1, 122, 139, 144, 149, 166, 177, 178 and 222, C.I. Pigment Orange series of 31 and 43, C.I. Pigment Yellow series of 14, 17, 93, 94 and 138, C.I. Pigment Green 7, C.I. Pigment Blue series of 15:3 and 60. These pigments may be used singly or in combination.

Number average of primary particle diameter of the colorant, which may vary depending on the species, is preferably about 10 to 200 nm.

The amount of the colorant is not particularly specified as far as it is sufficient to form images, and 1 to 10 weight percent in the Toner B is preferable.

Examples of internal additive to be added in the toner include a releasing agent, a charge controlling agent, etc.

Practical examples of the releasing agent include polyolefin compounds such as low molecular weight polypropylene having number average molecular weight of 1,500 to 9,000, low molecular weight polyethylene, ethylene-propylene copolymer, microcrystaline wax, Carnauba wax, Sazole wax, parafin wax, amide wax etc.

Practical examples of the charge controlling agent include a negative charge controlling agent an azo metal complex such as azo chromium complex, a salicylic chromium complex, a salicylic zinc complex and a calixarene compound, a positive charge controlling agent such as a Nigrosine dye and a quaternary ammonium salt, etc.

The employed coagulating agents are not particularly limited, however those selected from metal salts are more suitable. Specific examples include salts of univalent metals such as alkali metals, for example, sodium, potassium, lithium and the like; alkali earth metal salts of divalent metals such as calcium, magnesium, and the like; salts of divalent metals such as manganese, copper, and the like; and salts of trivalent metals such as iron, aluminum, and the like. Listed as specific salts can be sodium chloride, potassium chloride, lithium chloride, calcium chloride, zinc chloride, copper sulfate, magnesium sulfate, manganese sulfate, and the like. These may be employed in combination.

The added amount of the coagulant of the present invention is acceptable if it exceeds the critical coagulation concentration, and is preferably at least 1.2 times of the critical coagulation concentration, and is more preferably at least 1.5 times.

The critical coagulation concentration varies greatly depending on the emulsified components and dispersing agents themselves. For example, the critical coagulation concentration is described in Seizo Okamoto, et al. "Kobunshi Kagaku (Polymer Chemistry)", edited by Nihon Kobunshi Gakkai, whereby detailed critical coagulation concentration data can be obtained. Furthermore, as another method, ζ (zeta) potentials of a specified particle dispersion are measured upon adding a desired salt to the particle dispersion, while changing the salt concentration, and said salt concentration which varies the ζ potential can be obtained as the critical coagulation concentration.

A solvent which is infinitely soluble denotes a solvent which is infinitely soluble in water and as such solvents, those which do not dissolve the resin formed in the present invention are selected. Specifically, cited are alcohols such as methanol, ethanol, propanol, isopropanol, t-butanol, methoxyethanol, butoxyethanol, and the like, nitrites such as acetonitrile, and ethers such as dioxane. In particular, ethanol, propanol and isopropanol are preferred.

The added amount of such solvents which are infinitely soluble is preferably between 1 and 100 percent by volume of the polymer containing dispersion to which the coagulant is added.

In such the method, the isolation ratio of the specified element can be controlled by controlling the adding order and the adding time of the various raw materials, the polymerization condition of monomer, the aggregation condition of polymerized particles and the washing condition after reaction.

The polymerization method for preparing Toner B is not limited to an emulsion polymerization method, for example, a suspension polymerization method or a solution polymerization method are also usable as long as the isolation ratio of the specified element can be controlled to not more than 10% by number.

The suspension polymerization method is a method by which a polymerizable monomer composition prepared by mixing a compound containing the specified element such as the colorant, charge controlling agent or the magnetic substance, a polymerization initiator and a polymerizable monomer. The composition is dispersed and suspended in an aqueous medium and is subjected to the polymerization treatment. In such the case, an inorganic dispersion stabilizing agent such as tricalcium phosphate and colloidal silica, and an organic dispersion stabilizing agent such as polyvinyl alcohol and gelatin, and a surfactant such as sodium dodecylbenzene-sulfonate may be used.

By the solution polymerization method, the monomer, polymerization initiator and the substance containing the specified element such as the colorant, charge controlling agent and the magnetic substance are dissolved or dispersed in a solvent and the polymerization reaction is performed by heating. In such the case, there is no limitation on the solvent as long as the solvent can dissolve the monomer and the polymer or resin. Example of the solvent include acetone, methyl ethyl ketone, benzene, toluene, chloroform and THF.

As the polymerization initiator in the suspension polymerization method and the solution polymerization method, an oil-soluble radical polymerization initiator such as azoisobutyronitrile and lauryl peroxide, is usable. In the invention, it is preferred that the toner is prepared by the emulsion polymerization method, even though various methods can be utilized as above-mentioned. The reason of such the fact is not confirmed but the emulsion polymerization method is preferably as the preparation method of the polymerized toner in the invention since an extreme small amount of isolated substance can be formed because the compound containing the specified element is coagulated with the resin particle in the aqueous medium to form a toner in this method.

In the toner for developing electrostatic image according to the invention, the glass transition point of the binder resin measured by a differential thermal analysis is preferable within the range of from 20° C. to 90° C.

The softening point of the binder resin measured by a Flowtester is preferably within the range of from 80° C. to 220° C.

It is preferable that the binder resin has a number average molecular weight Mn of from 1,000 to 100,000, a weight average molecular weight Mw of from 2,000 to 1,000,000, and a molecular weight distribution Mw/Mn of from 1.5 to 100, particularly 1.8 to 70.

In the toner for developing electrostatic image according to the invention, various external additives may be added according to necessity.

Known inorganic fine particles or organic fine particles may be added as the external additive, and the addition of the inorganic fine particle is preferable from the viewpoint of giving a flowing ability to the colored particle.

Various compounds such as various inorganic oxides, nitrides and boronide may be used as the substance constituting the inorganic fine particle. Examples of such the compound include silica, alumina, titania, zirconia, barium titanate, aluminum titanate, strontium titanate, magnesium titanate, calcium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The number average primary particle diameter of the inorganic fine particle to be used as the external additive is preferably from 10 to 500 nm. The number average primary particle diameter of the inorganic fine particle is measured by the analysis of image obtained by electron microscopic observation using a transmission electron microscope.

The surface of the inorganic fine particle is preferably subjected to a hydrophobilizing treatment using a coupling agent such as a titanium coupling agent and a silane coupling agent, a silicone oil, a metal salt of fatty acid such as aluminum stearate, zinc stearate and calcium stearate.

<Developer>

The developer according to the invention contains the above-mentioned toner, which may be a single-component developer comprising a magnetic toner containing a magnetic substance or a non-magnetic toner containing no magnetic substance, or a two-component developer comprising the toner and a carrier.

In the case of the two-component developer, the carrier may be a carrier composed of magnetic substance particle only, or a resin coated carrier which is composed of a core particle composed of a magnetic substance and a resin covering the core particle.

The size of the carrier is preferably from 20 to 150 μm, preferably from 20 to 100 μm in volume average diameter.

As the raw material of the core particle, iron, ferrite and magnetite are usable.

As the resin for making the resin coated carrier, a known resin such as a silicone resin, a styrene-acryl resin and a fluorine-containing acrylic acid ester may be used without any limitation.

The image forming method according to the invention comprises the steps of forming an electrostatic image on the surface of a photoreceptor, developing the electrostatic image by a developer to form a toner image on the surface of photoreceptor, transferring the toner image to a recording medium and fixing the transferred toner image, in which the above-mentioned toner is used.

A contact developing method in which a developer layer formed on a developer transportation carrying member is contacted with the photoreceptor, and a non-contact developing method, in which the developer layer is not contacted with the photoreceptor, are either usable as the method for developing the electrostatic image.

(1) Contact Developing Method

When the contact developing method is performed, the thickness of the developer layer formed on the developer transportation carrying member is preferably from 0.1 to 8 mm, more preferably from 0.4 to 5 mm, in the developing zone.

The space between the photoreceptor and the developer transportation carrier member is preferably from 1.5 to 7 mm, more preferably from 0.2 to 4 mm.

(2) Non-Contact Developing Method

FIG. 1 shows a scheme of a developing section for the non-contact developing method which can suitably be applied for image forming method of the invention. In the drawing, 1 is the photoreceptor, 2 is the developer transportation carrying member, 3 is the two-component developer according to the invention, 4 is a developer amount regulating member, 5 is a developing zone, 6 is a thin layer of the developer, and 7 is a power source to apply an alternating electric field.

The developer transportation carrying member 2 is a developing device having a developing sleeve 2A and a magnet 2B, and the surface of the developer transportation carrying member 2 is constituted by a material such as aluminum, anodized aluminum and a stainless steel.

The diameter of the developer transportation carrying member 2 is preferably from 10 to 40 mm. When the diameter is too small, the sufficient contact for giving an electric charge to the toner difficultly obtained, and when the diameter is too large, a problem of toner scattering is raised since the centrifugal force is increased.

The two-component developer 3 is carried by magnetic force on the developer transportation carrying member 2 which has the magnet 2B, and transported into the developing zone 5 by the move of the developing sleeve 2A.

The thickness of the thin layer of the developer 6 transported into the developing zone 5 is regulated by the pressure of the developer amount regulating member 4 so that the developer layer does not contact to the photoreceptor.

The thickness of the developer layer 6 in the developing zone 5 is preferably from 20 to 500 μm.

The pressure of the developer amount regulating member is preferably from 1 to 15 gf/mm, more preferably from 3 to 10 gf/mm. When the pressure is too small, the transportation tends to be instable since the regulation force is insufficient. On the other hand, when the pressure is too large, the durability of the developer tends to be lowered since the stress to the developer is increased.

A urethane blade and a phosphor bronze plate may be used as the developer amount regulating member.

The minimum space $D_{sd}$ in the developing zone 5 is, for example approximately from 100 to 1000 μm which is larger than the thickness of the developer layer 6, preferably from 20 to 500 μm, transported into the developing zone 5.

The power source 7 for applying the alternating electric field is preferably a power source supplying an alternative current of a frequency of from 1 to 10 kHz and a voltage of from 1 to 3 $kV_{p-p}$. The power source may be one supplying an alternating current overlapped with a direct current. The voltage of the direct current is preferably from 300 to 800 V. When a bias voltage is applied for developing process, both of a method applying only direct current and that applying an alternative current may applicable.

When the image forming method of the invention is utilized for forming a color image, both of (1) a successive transfer method by which mono-tone image is successively formed on the photoreceptor and transferred one by one onto an image supporting sheet and (2) a collective transfer method by which plural mono-tone images are developed the photoreceptor to form a color image and the color image is collectively transferred to the image supporting sheet, may be usable, and the method of (2) is preferable from the viewpoint of inhibiting the deviation of color images.

EXAMPLES

The examples of the invention are described below in concrete. However, the embodiment of the invention is not limited to the examples.

(1) Preparation of Toner

Examples 1 to 4, 6 and 16 and Comparative Examples 1 to 2

A binder resin, a colorant, a mold releasing agent and a charge controlling agent were previously mixed according to the receipt shown in Table 1. The mixture was molten, kneaded, crushed and classified to prepare a colored, particle. In such the procedure, the conditions of the crushing and the classifying were controlled while measuring the isolation ratio of the specified element. The external additives shown in Table 1 is added and mixed with the colored particle the prepare the toners of the invention and the comparative toners.

The silica and titanium oxide used as the external additives were each previously subjected to a hydrophobilizing treatment. The isolation ratio of the toner treated above was measured.

TABLE 1

| | | | Example | | | | | | Comparative example | |
|---|---|---|---|---|---|---|---|---|---|---|
| | | | 1 | 2 | 3 | 4 | 6 | 16 | 1 | 2 |
| Receipt of raw material composition of colored particle (Parts by weight) | Binder resin | Styrene-acrylate resin 1 | 100 | 100 | 100 | 100 | | 100 | | 100 |
| | | Styrene-acrylate resin 2 | | | | | | | | |
| | | Polyester resin | | | | | 100 | | 100 | |
| | Colorant | Magnetite | 105 | 105 | 105 | 105 | | | 105 | |
| | | Copper phthalocyanine type cyan pigment | | | | | 3 | | | |
| | | Quinacridone magenta type pigment | | | | | | | | |
| | | Benzidine yellow type pigment | | | | | | | | |
| | | Carbon black | | | | | | 10 | | 10 |
| | Mold releasing agent | Low molecular weight polypropylene | 3.5 | 3.5 | 4 | 3.5 | | 4 | | 4 |
| | | Low molecular weight polyethylene | | | | | 3 | | 4 | |
| | | Fatty acid amide wax | | | | | | | | |
| | Charge controlling agent | Iron-azo complex | 1 | 1 | 1 | 0.7 | | | 1 | 1 |
| | | Chromium salicylic acid complex | | | | | | | | |
| | | Zinc salicylic acid complex | | | | | | | | |
| | | Molybdenum quaternary ammonium complex | | | | | | 2 | | |
| External additive (added amount to colored particle in parts by weight) | | Silica | 1 | 1 | 1 | 1 | 2.5 | | 1 | 25 |
| | | Positively chargeable silica | | | | | | 1 | | |
| | | Titanium oxide | | | | | 0.5 | | | 0.5 |

Example 17

Into a solution composed of 270 ml of water, 3 g of a nonionic emulsifying agent, 4.5 g of an anionic emulsifying agent and 6 g of potassium persulfate, 220 g of styrene monomer, 40 g of butyl acrylate and 12 g of acrylic acid were added and reacted for 8 hours at 70° C. while stirring to polymerize. Thus an emulsion of polymer particles was obtained. To the emulsion, 11 g of a copper phthalocyanine type cyan pigment, 60 g of a polypropylene emulsion having a solid component content of 30% by weight and 1620 ml of purified water were added. The mixture was maintained at 30° C. for 2 hours while stirring and dispersing by a slusher. Moreover, the emulsion was heated by 70° C. and maintained at this temperature for 3 hours while stirring. Then the emulsion was cooled and filtered. Thus obtained solid product was washed, dried and crushed to obtain colored particles.

To 100 parts by weight of the colored particles, 2.5 parts by weight of silica and 0.5 parts by weight of titanium oxide were added as external additives and mixed to prepare a toner according to the invention. The silica and the titanium oxide used as the external additives were each previously subjected to a hydrohobilizing treatment.

Example 18

Into a solution composed of 600 ml of purified water and 5.0 g of sodium dodecylsulfate, 11 g of a copper phthalocyanine type cyan pigment was added, and the mixture was stirred while applying ultrasonic wave to sufficiently disperse the cyan pigment. Thus a dispersion was prepared.

Besides, a low molecular weight polypropylene was emulsified in water while heating to prepare an emulsifying dispersion having a solid component content of 30% by weight.

The dispersion containing the copper phthalocyanine type cyan pigment was mixed with the emulsifying dispersion containing the lower molecular weight polypropylene. To the mixture, 220 g of styrene monomer, 40 g of n-butyl acrylate monomer, 12 g of methacrylic acid monomer, 5.4 g of t-dodecylmercaptane and 1620 ml of deaerated water were added, and the mixture was heated by 70° C. under a nitrogen gas current while stirring. Emulsion polymerization was performed by adding a solution composed of 440 ml of water in which 4.3 g of potassium persulfate was dissolved and maintaining at 70° C. for 3 hours.

To 1000 ml of the polymerizing liquid thus obtained, sodium hydroxide was added to adjust the pH to 9.5. Then 270 ml of a 2.2 mole-% solution of potassium chloride and a solution composed of 67 ml of water dissolved therein 160 ml of isopropyl alcohol, 9.0 g of polyoxyethyleneoctylphenyl ether having an average polymerization degree of 10 were further added. Thus obtained reacting liquid was maintained at 75° C. and stirred for 6 hours.

Thereafter, the reacting liquid was filtered. The solid composition was washed 3 times by a mixture of methanol and water in a ratio of 1:1, and dried and crushed to prepare colored particles.

To 100 parts by weight of the colored particles, 2.5 parts by weight of silica and 0.5 parts by weight of titanium oxide were added as external additives and mixed to prepare a toner according to the invention. The silica and the titanium oxide used as the external additives were each previously subjected to a hydrohobilizing treatment.

Comparative Example 3

To a solution composed of 270 ml of purified water, dissolved therein, 3 g of nonionic emulsifying agent 4.5 g of an anionic emulsifying agent and 6 g of potassium persulfate, 220 g of styrene monomer, 40 g of butyl acrylate and 12 g of acrylic acid were added. The mixture was polymerized at 70° C. for 8 hours while stirring to obtain an emulsion. To the emulsion, 11 g of a copper phthalocyanine type cyan pigment, 60 g of a polypropylene emulsion having a solid composition content of 30% by weight and 1620 ml of purified water were added. The emulsion was maintained at 30° C. for 0.5 hours while dispersing and stirring by a slusher. Then the mixture was heated by 70° C. and stirred for 3 hours. Thereafter, the emulsion was cooled and filtered to separate the solid composition. The solid composition was washed by water, dried and crushed to prepare colored particles.

To 100 parts by weight of the colored particles, 2.5 parts by weight of silica and 0.5 parts by weight of titanium oxide were added as external additives and mixed to prepare a toner according to the invention. The silica and the titanium oxide used as the external additives were each previously subjected to a hydrohobilizing treatment.

The kind, the content and the isolation ratio of the specified element contained in the toners of Examples 1 to 18 and Comparative Examples 1 to 3 are shown in Table 2.

The measurement of such the values were carried out by the use of Particle Analyzer, manufactured by Yokogawa Denki Co., Ltd., under the following conditions.

Detected number of C: Approximately 1500

Noise cutting level: Not more than 1.5

Sorting time: 20 digits

Gas: 0.1% of ozone, Helium gas

The data of the whole particles measured under the following conditions were plotted on a graph in which the horizontal axis showed the light emission voltage caused by carbon and the vertical axis showed the light emission voltage caused by the specified element. The number of particles plotted at the position of light emission voltage caused by carbon was zero was counted and the percentage of number of such the particle to the whole number of the particles measured was calculated.

(2) Preparation of Developer

The toners prepared in Examples 1 to 4 and Comparative example 1 were each used as a one-component developer.

Besides, two-component developers each having a toner content of 8% were prepared using the toners of Examples 6 and 16 to 18 and Comparative Examples of 2 to 3 using carrier 1 or 2 each composed of core particles having an average diameter of 45 μm coated with styrene-acryl resin, of carrier 3 composed of core particles having an average diameter of 45 μm coated with a silicone resin according to Table 2.

(3) Image Formation

Practical printing tests of 10,000 sheets of image information having a image area ratio of 5% were performed using each of the one-component developer relating to Examples 1 to 4 and Comparative example 1 by a printer KL2010, manufactured by Konica Corporation, which was modified so as to be fitted to the development by the one-component developer. The charged amount of the toner was measured at the initial time and, and the image after 100,000 sheets of printing was visually observed to check the formation of fog.

One the other hand, practical printing tests of 10,000 sheets of image formation having a image area ratio of 5% were performed using each of two-component developer relating to Examples 6 and 16 to 18 and comparative examples 2 and 3 by a printer KL2010, manufactured by Konica Corporation, which was modified so as to be fitted to the development by the two-component developer. The charged amount of the toner was measured at the initial time, and the image after 100,000 sheets of printing was visually observed to check the formation of fog at the background of the image.

The results of the tests are shown in Table 2.

TABLE 2

| | Specific element in toner | | | | Charging amount | | |
|---|---|---|---|---|---|---|---|
| | Kind | Content (% by weight) | Isolated ratio | Kind of carrier | Initial time | After 10,000 printing | Formation of fog |
| Example 1 | Fe | 33.9 | 0.5 | — | −5.3 | −5.1 | None |
| Example 2 | Fe | 34.0 | 5.2 | — | −5.3 | −4.2 | None |
| Example 3 | Fe | 33.5 | 3.1 | — | −5.2 | −4.5 | None |
| Example 4 | Fe | 33.8 | 0.3 | — | −4.1 | −4.1 | None |
| Example 6 | Cu | 0.29 | 8.6 | carrier 2 | −20.7 | −15.8 | None |
| Example 16 | Mo | 0.80 | 1.7 | carrier 1 | 23.5 | −22.2 | None |
| Example 17 | Cu | 0.39 | 5.0 | carrier 1 | −22.4 | −19.1 | None |
| Example 18 | Cu | 0.39 | 1.4 | carrier 1 | −23.7 | −22.7 | None |
| Comparative Example 1 | Fe | 33.3 | 12.3 | — | −5.2 | −2.1 | Fog Found |
| Comparative Example 2 | Fe | 0.29 | 10.5 | carrier 1 | −22.1 | −13.2 | Fog Found |
| Carparative Example 3 | Cu | 0.38 | 11.4 | carrier 2 | −23.7 | −12.9 | Fog Found |

As is shown in Table 2, it is confirmed that the lowering in the charged amount of the toner is small after continuous image formation and the image can be stably formed when the toners relating to Examples 1 through 18 were used, since in each of the toners the isolation ratio of the specified element is not more than 10% by number.

The change in the charging property caused by contamination of the charge providing member is inhibited when the image formation is continued for a long period of time, and stable images are formed for many times of image formation by the toner for developing electrostatic image according to the invention.

The change in the charging property caused by contamination of the charge providing member is inhibited when the image formation is continued for a long period of time, and stable images are formed for many times of image formation by the developer for developing electrostatic image according to the invention.

The change in the charging property caused by contamination of the charge providing member is inhibited when the image formation is continued for a long period of time, and stable images are formed for many times of image formation by the image forming method for developing electrostatic image according to the invention.

The invention claimed is:

1. A toner for developing an electrostatic image, comprising:

a resin binder and, not less than 0.1% by weight of an element which is provided in the form of a colorant pigment comprising copper phthalocyanine wherein the element is copper;

wherein the toner has an isolation ratio of the element of not more than 10% and greater than 0.1% by number; where the isolation ratio of the element is determined by measuring light emission voltage caused by carbon and the element of particles present in the toner with a fluorescent X-ray analysis and defined as 100 times the number of particles exhibiting emission from the element but not exhibiting emission from carbon divided by the sum of the number of particles exhibiting emission from the element but not exhibiting emission from carbon and the number of particles exhibiting emission from the element and exhibiting emission from carbon, and wherein the colorant pigment has an average primary particle diameter of 10 to 200 nm, and the resin binder has an Mn of 1,000 to 100,000, an Mw of 2,000 to 1,000,000, and a molecular weight distribution (Mw/Mn) of 1.5 to 100.

2. The toner of claim 1, wherein the toner is prepared by emulsion polymerization.

3. A developer for developing electrostatic image comprising a toner of claim 1.

4. A developer for developing electrostatic image comprising a toner of claim 1 and a carrier.

5. The toner of claim 1, wherein the molecular weight distribution (Mw/Mn) is 1.8 to 70.

6. An image forming method comprises the steps of forming an electrostatic image on the surface of a photoreceptor, developing the electrostatic image by a developer to form a toner image, transferring the developed toner image to a recording medium, and fixing the toner image transferred on the recording medium, wherein the developer comprises the toner of claim 1.

7. The method of claim 6, wherein developing is performed with a non-contact method in which a developer layer is not contacted with the surface of the photoreceptor.

* * * * *